US007930911B1

(12) United States Patent
Rothrock, Jr.

(10) Patent No.: US 7,930,911 B1
(45) Date of Patent: Apr. 26, 2011

(54) APPARATUS AND METHOD FOR COOKING AND DISPENSING STARCH

(75) Inventor: William Curtis Rothrock, Jr., Broken Arrow, OK (US)

(73) Assignee: Yale Cleaners, Inc., Broken Arrow, OK (US)

( * ) Notice: Subject to any disclaimer, the term of this patent is extended or adjusted under 35 U.S.C. 154(b) by 1238 days.

(21) Appl. No.: 11/539,014

(22) Filed: Oct. 5, 2006

(51) Int. Cl.
*D06F 37/00* (2006.01)
*D06F 39/00* (2006.01)

(52) U.S. Cl. ..... 68/207; 127/28

(58) Field of Classification Search ..... None
See application file for complete search history.

(56) References Cited

U.S. PATENT DOCUMENTS 4,519,445 A * 5/1985 Norris ..... 165/76
5,437,169 A 8/1995 Mitchell et al.
5,680,663 A 10/1997 Mitchell et al.
5,901,584 A 5/1999 Mitchell et al.
5,964,950 A 10/1999 Boling
6,507,966 B1 1/2003 Mitchell et al.
6,619,076 B2 * 9/2003 Boling ..... 68/17 R

* cited by examiner

*Primary Examiner* — Michael Barr
*Assistant Examiner* — Jason Y Ko
(74) *Attorney, Agent, or Firm* — Head, Johnson & Kachigian, P.C.

(57) ABSTRACT

An apparatus and method for cooking and dispensing starch to a commercial laundry machine comprising a mixing tank for mixing and storing a starch and water solution which is attached to a means for discharging the starch and water solution to a heat exchanger. The heat exchanger is a shell and tube heat exchanger, either one-phase or two-phase, used for cooking the starch and water solution to form cooked starch. As the starch and water solution is passed through the tube side of the heat exchanger, it is cooked using heat energy from a heating source contained in the shell side of the heat exchanger. The cooked starch is then dispensed through a manifold valve system to one or more commercial laundry machines. After the cooked starch is dispensed, a solenoid valve opened to flush the apparatus with fresh water. A programmable computer receives a request from a commercial laundry machine for a desired starch level, discharges the starch and water solution through the apparatus for cooking, and dispenses the cooked starch to the requesting laundry machine through a series of discharge and manifold valves. The programmable computer controls the solenoid valve for flushing the apparatus with water, the discharging means and a means for recirculating the starch and water solution.

11 Claims, 2 Drawing Sheets

APPARATUS AND METHOD FOR COOKING AND DISPENSING STARCH

BACKGROUND OF THE INVENTION

1. Field of the Invention

The present invention relates to an improved apparatus and method for cooking a starch and water solution to form cooked starch and then dispensing the cooked starch into a commercial laundry machine. More particularly, the present invention relates to an improved commercial starch cooking apparatus and method wherein the starch and water solution and a heating source are passed through a heat exchanger for cooking to form cooked starch, which is then delivered to one or more commercial laundry machines. The present invention cooks and dispenses starch in single batches or multiple single batches; starch may be dispensed in a continuous stream subject to the heat exchanger size and rate of flow of the constant heating source.

2. Prior Art

In the dry cleaning industry today, there are various starch cookers for cooking a mixture of corn starch and water for the purpose of starching dress shirts, blue jeans, khaki pants, tablecloths, cotton napkins and other items of clothing. Ideally, the mixture of corn starch and water should reach a cooked temperature of range of 180 degrees Fahrenheit to 205 degrees Fahrenheit, preferably the mixture should be cooked to a temperature range of 190 degrees Fahrenheit to 195 degrees Fahrenheit. If the starch mixture is cooked too hot, the chemical and physical makeup of the starch solution continues to change causing, the mixture to form a glue-like slurry.

Presently, three (3) main methods for cooking starch are used. A first method utilizes an open pan batch method where the starch is hand poured into the open pan cooker. This method is extremely dangerous and very labor intensive. A second method uses an open pan batch to cook the starch, but the starch is fed into the open pan cooker using a pump and pipe. This method results in high maintenance costs due to starch build-up in the pump and pipes, and thus requires continuous, labor intensive cleaning. In addition, this method demands a high level of attention from the operator. A third method used today is the steam-injected, closed-batch method utilizing a pump and pipe for feeding starch into the cooker. This method relies on direct steam injection from a boiler; however, boiler treatment compounds, along with rust, calcium and other contaminates are also injected with the steam into the starch. These undesirable contaminants adhere to the clothing items. Further, this method uses a violent mixture of steam and starch solution which cannot be accurately controlled resulting in incomplete starch cooking.

Mitchell, et al. (U.S. Pat. No. 5,437,169) discloses a starch cooking device that utilizes a tank float device to open and close a water supply line. The float is immersed in the starch and water solution causing starch build-up on the float and pipes thus requiring continuous, labor intensive cleaning. Mitchell also discloses using direct steam injection to both cook and agitate the starch and water solution. This may result in lumpy starch, thus causing uneven starching of garments. Furthermore, as previously mentioned, direct steam injection may result in contaminants mixing with the starch solution causing contamination and discoloration of garments.

Mitchell, et al. (U.S. Pat. No. 5,680,663) discloses a starch cooking device that utilizes a tank float device to open and close a water supply line. The float is immersed in the starch and water solution causing starch build-up on the float and pipes, thus requiring continuous, labor intensive cleaning.

Mitchell also discloses using direct steam injection to both cook and agitate the starch and water solution. This may result in lumpy starch, thus causing uneven starching of garments. Furthermore, as previously mentioned, direct steam injection may result in contaminants mixing with the starch solution causing, contamination and discoloration of garments.

Mitchell, et al. (U.S. Pat. No. 5,901,584) discloses a starch cooking device having a starch cooking valve for direct steam injection. In this patent, a starch solution is mixed with a direct injection of steam in the starch cooking valve to form cooked starch. This patent also utilizes a hopper and auger assembly to agitate the starch and water solution. As previously mentioned, the reaction between the starch solution and a direct injection of steam is violent and may result in the incomplete cooking, of starch. Further, using an auger to agitate the starch and water solution may result in the auger tunneling through the starch, leaving air pockets or tunnels in the starch and water mixture.

Boling (U.S. Pat. No. 5,964,950) is directed towards a starch cooking device having a single vessel or mixing, cooking a starch solution. MS patent uses a recirculating flow line with a gear pumping arrangement to break up lumps in the starch. This patent requires a user to add starch to the vessel for cooking. As discussed above, this hand pour, open batch method is extremely dangerous for commercial applications, and is also very labor intensive.

Mitchell, et al. (U.S. Pat. No. 6,507,966) also discloses a starch cooking device that uses a hopper and auger for mixing a starch and water solution and a steam valve for direct steam injection for cooking the starch and water mixture. Again, the reaction between the starch solution and a direct injection of steam is a violent reaction which may result in the incomplete cooking of starch. Also, using an auger to agitate the starch and water solution may result in the auger tunneling through the starch, leaving air pockets or tunnels in the starch and water mixture.

Accordingly, it is desirable to produce a starch cooking device that completely cooks a starch and water solution without the addition of any contaminants and other impurities.

It is also desirable to form a starch cooking device that utilizes a flushing system to eliminate starch build-up which otherwise requires labor intensive cleaning.

It is desirable to have a starch cooker that is predominantly automated using a programmable computer to control mixing, cooking and flushing procedures.

It is also desirable for a starch cooker to deliver multiple levels of starch to a commercial laundry machine depending on the user's needs.

It is further desirable for a starch cooker to have a closed system in which the starch and water solution and the heating source are contained in separate chambers, thus cooking the starch without any possibility of contamination during the cooking process.

BRIEF SUMMARY OF THE INVENTION

The present invention relates to an improved apparatus and method for cooking a starch and water solution to form cooked starch and then dispensing the cooked starch to a commercial laundry machine. The preferred embodiment of the present invention comprises a mixing tank for mixing and storing a starch and water solution attached to a means for discharging the starch and water solution to a heat exchanger. The heat exchanger is a shell and tube heat exchanger used for cooking the starch and water solution to form cooked starch. As the starch and water solution is passed through the tube side of the heat exchanger, it is cooked using heat energy from a heating source contained in the shell side of the heat exchanger. The cooked starch is then dispensed through a manifold valve system to one or more commercial laundry machines. After the cooked starch is dispensed, an electronic solenoid valve is opened to flush the apparatus with fresh water. A programmable computer is communicably attached to the mixing tank, the recirculating means, the discharging means, the manifold valve system and the solenoid valve. The programmable computer receives a request from as commercial laundry machine for a desired starch level, discharges the starch and water solution through the heat exchanger for cooking, and dispenses the cooked starch to the requesting laundry machine through the series of discharge and manifold valves.

The present invention cooks and dispenses starch in single batches as well as multiple single hatches. It may also be used to dispense starch in a continuous stream subject to the heat exchanger size and rate of flow of the constant heating source.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
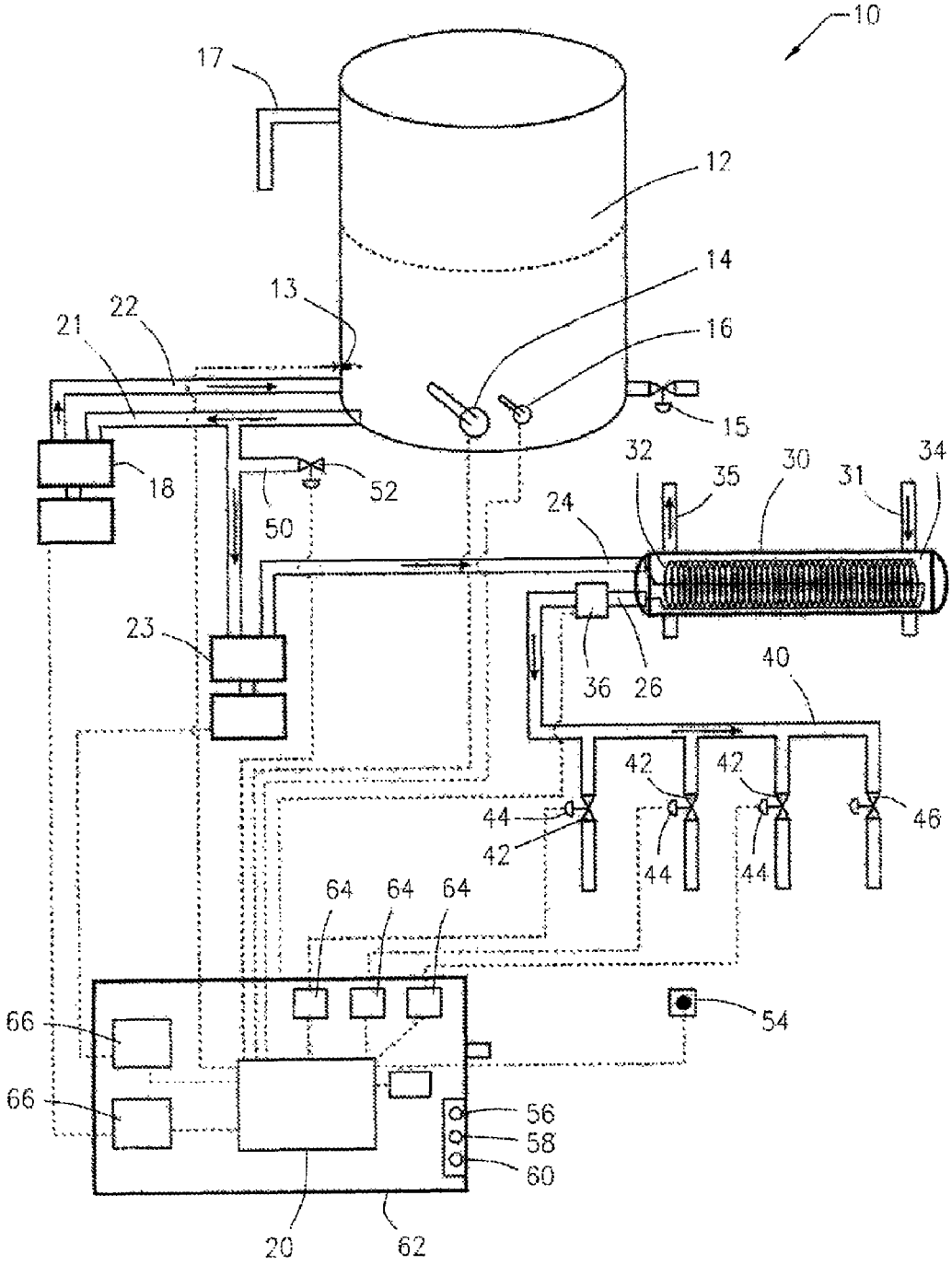
FIG. 1 is a perspective view of the preferred embodiment of the present invention.
Figure 2:
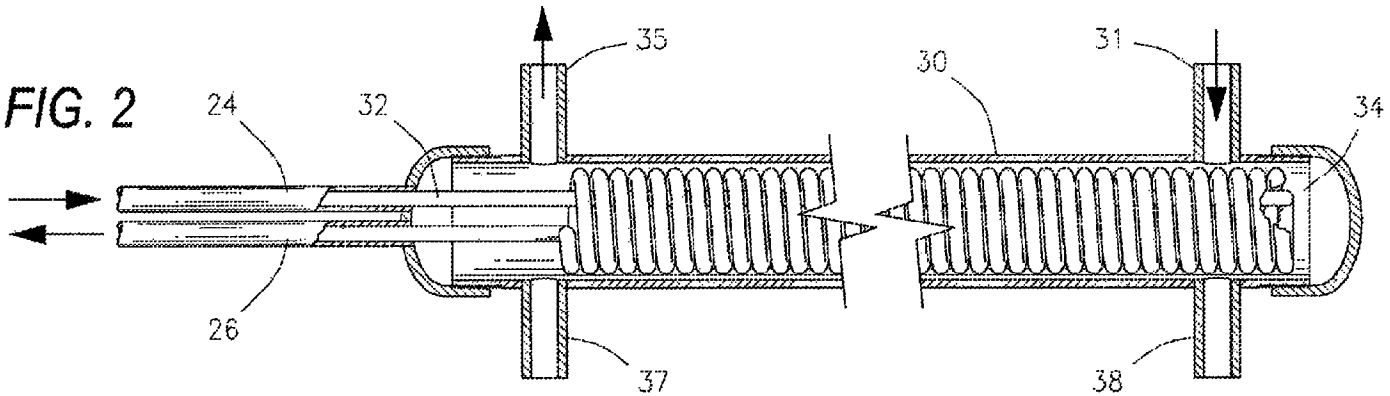
FIG. 2 is a perspective, cut-away view of the heat exchanger of the preferred embodiment.

FIGS. 1 and 2 show generally the preferred embodiment of the present invention designated generally by the numeral 10. Starch cooking apparatus 10 comprises a mixing tank 12 for mixing and storing water with dry starch to form a starch and water solution. Mixing tank 12 has a heating element 14 thermostatically controlled by a temperature probe 16 for heating the starch and water solution to an initial temperature range of 55 degrees Fahrenheit to 110 degrees Fahrenheit, preferably 79 degrees Fahrenheit to 81 degrees Fahrenheit. Those skilled in the art will appreciate the starch and water solution may also be heated by other heating means, such as using a heating element that is in communication with a programmable computer 20. The programmable computer would be programmed to run the heating element to maintain the starch and water solution in the desired temperature range. Located near a bottom portion of mixing tank 12 is low liquid level indicator 13. Low liquid level indicator 13 is communicably attached to an alarm (not shown) which would sound with either an audible or visual warning when the tank level is low or when the starch and water solution does not reach the designated parameters. Also located near a bottom portion of mixing tank 12 is manual drain valve 15 for allowing a user to manually drain the mixing tank. Located near a top portion of mixing tank 12 is overflow pipe 17.

Attached to mixing tank 12 is a means to recirculate the starch and water solution, shown in FIG. 1 as recirculating pump 18. Recirculating pump 18 of the preferred embodiment is a high volume recirculating pump, which is communicably attached to programmable computer 20. Programmable computer 20 may be preprogrammed to run recirculation pump 18 for short intervals, such as throughout the day. In the preferred embodiment, recirculating pump 18 requires two (2) connections 21 and 22 located near the bottom of mixing tank 12. One of the connections is for intake 21 into recirculation pump 18, while the other connection is for discharge 22 back into mixing tank 12 for mixing and recirculating the starch and water solution over heating element 14.

Apparatus 10 of the present invention further includes a means for discharging the starch and water solution from mixing tank 12. In the preferred embodiment, the means for discharging is a starch delivery pump 23. Like recirculating pump 18, starch delivery pump 23 is a high volume pump. Starch delivery pump 23 takes suction from a tee connection in the recirculation pump inlet line 21. This allows starch delivery pump 23 to run simultaneously with recirculating pump 18. Those skilled in the art will appreciate that apparatus 10 may be operated with one all-purpose, high volume pump, in lieu of recirculating pump 18 and starch delivery pump 23. Starch delivery pump 23 is communicably attached to programmable computer 20. Programmable computer 20 receives a signal from a commercial laundry machine (not shown) specifying the load size and desired amount of starch. The discharging means of the present invention delivers the starch and water solution from mixing tank 12 to heat exchanger 30 in order to cook the starch and water solution to a final temperature.

In the preferred embodiment of the present invention, heat exchanger 30 is a shell and tube heat exchanger. Heat exchanger 30 may be either a one-phase or two-phase heat exchanger. Two (2) fluids, the starch and water solution from mixing tank 12 and a heating source, of different starting temperatures, flow through the heat exchanger. Preferably, the starch and water solution flows through tube side 32 and a heating source is located in shell side 34 of heat exchanger 30. Heat is transferred from shell side 34 to the tube side 32, through the tube walls. In order to transfer heat efficiently, the tube side 32 is oversized to provide for a large heat transfer area and to allow the starch and water solution to achieve a slow steady temperature rise from the initial mixing tank temperature to the final cooked starch temperature. This low degree temperature approach ensures a stable and accurate final "cook" temperature. A constant flow of the heating source through shell side 34 provides heat to slowly and thoroughly cook the starch and water solution without overheating the cooked starch or introducing rust, boiler chemicals or other contaminants into the cooked starch. The temperature of the heating source is preferably constant, above 190 degree Fahrenheit but not above the maximum cooked starch temperature. The heating source may be hot water, various heating oils, steam condensate, steam or any other fluids, along with a closed loop pump system or boiler.

Those skilled in the art will appreciate that the performance of heat exchanger 30 may be affected by the addition of tins or corrugations in one or both directions, which increase surface area and may channel fluid flow or induce turbulence. It is well known in the art of heat exchangers that in order to be able to transfer heat well, the tube material should have good thermal conductivity. Because heat is transferred from the hot side to the cold side, there is a temperature difference along the tubes. Also, because tube materials tend to thermally expand at varying temperatures, thermal stress on the material occurs during the heat exchangers normal operation. The material for the heat exchanger should not react with both the shell and tube side fluids in order to minimize deterioration, such as rust and corrosion. Thus, it is preferable that the heat exchanger be made of cast iron, steel, stainless steel, copper, aluminum or other strong, thermally-conductive, corrosion-resistant, high quality tube material.

Figure 3:
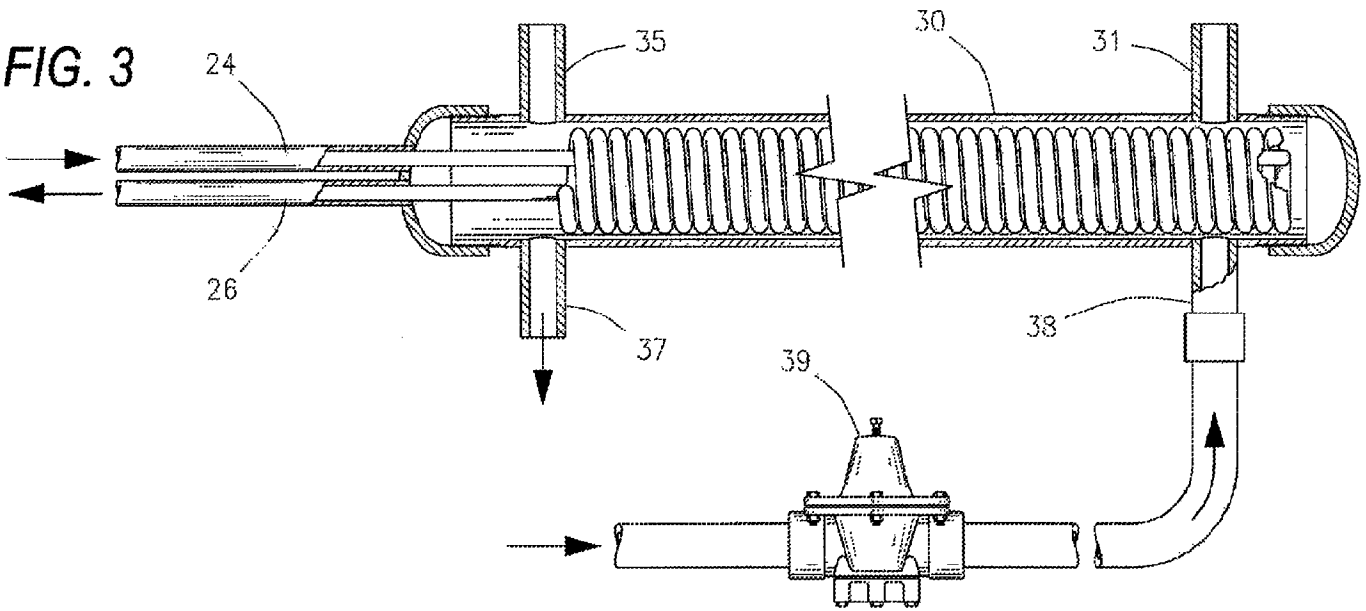
FIG. 3 is a perspective view of an alternate embodiment of the present invention utilizing the heat exchanger, a steam inlet, and a temperature-regulating valve connected to the steam inlet.

In the preferred embodiment, heat exchanger 30 will have at least one tube side inlet 24 for delivering the starch and water solution to tube side 32 and at least one tube side outlet 26 for discharging the cooked starch. Heat exchanger 30 will also have at least heat source one inlet 31 and at least one heat source outlet 35 for delivering the heat source. Preferably, if steam condensate, hot water or hot oil is used as the heating source, heat source inlet 31 and heat source outlet 35 should be located on the top portion of heat exchanger 30. This allows shell side 34 to be completely filed with a constant flow of the heating source. If steam is used as the heating source, heat source inlet 31 and heat source outlet 35 should be located on a bottom portion of heat exchanger 30. As an alternate embodiment, as shown in FIG. 3, if steam is used as the heat source, heat exchanger 30 requires the addition of steam outlet 37, steam inlet 38, and a steam temperature-regulating valve 39 to insure the steam is at a proper, constant temperature for cooking the starch and water solution.

Once the discharging means, or in the preferred embodiment a starch delivery pump 23, passes the starch and water solution into tube side inlet 24 and through tube side 32 of heat exchanger 30 to form cooked starch, the cooked starch is discharged from tube side outlet 26 and dispensed to one or more commercial laundry machines (not shown). In the preferred embodiment, a temperature probe 36 is located near the output of heat exchanger 30 to ensure the cooked starch is cooked to a temperature of range of 180 degrees Fahrenheit to 205 degrees Fahrenheit, preferably to 190 degrees Fahrenheit to 195 degrees Fahrenheit. When apparatus 10 is used will more than one (1) commercial laundry machine, the cooked starch is delivered from heat exchanger 30 to manifold valve system 40. The control valves of manifold valve system 40 are modified ball valves 42 with air piston 44 activation. Ball valves 42 allow a full throat opening in order to minimize starch blockage. Manifold valve system 40 is communicably attached to programmable computer 20. When programmable computer 200 receives a request from one or more commercial laundry washers, programmable computer 20 stacks the request and processes each request with a normal cook and flush cycle. Also connected to manifold valve system 40, is a manual control valve 46 allowing an operator to run a manual starch test for quality control, thorough cooking and consistency.

In the preferred embodiment of apparatus 10, a flush cycle is also performed to flush the discharging means and tube side 32 of heat exchanger 30 of any remaining starch. A flushing inlet 50 is connected to a fresh water supply. An electronic solenoid valve 52 is used to regulate the introduction of fresh water. Flushing inlet 50 and solenoid valve 52 are located between the mixing tank and starch delivery pump 23 so that fresh water will flush starch delivery pump 23 and heat exchanger 30. Electronic solenoid valve 52 is communicably attached to programmable computer 20. Programmable computer 20 is programmed to flush the system for a pre-determined time depending, upon the distance between apparatus 10 and the commercial laundry machine(s). The pre-determined flush time may also vary on the design of heat exchanger 30.

Programmable computer 20 is preferably a programmable logic controller which receives electronic signals from one or more commercial laundry machines. Programmable computer 20 has multiple pre-programmed steps which allows starch delivery pump 23 to TEM for different times, thus delivering multiple levels of cooked starch. An adjust switch 54 is provided allowing the operator to select the desired level or starch (light, medium, heavy or extra heavy starch). In addition to adjust switch 54, push buttons 56 and 58 allow the operator to incrementally change the desired level of starch, thus allowing the operator to fine tune the starch level based on a particular consumer's needs. A test starch cycle push button 60 is also communicably attached to programmable computer 20. Push button 60, in combination with manual control valve 46, to allow the operator to periodically test the starch level prior to running a full cycle.

As previously mentioned, programmable computer 20 controls recirculation pump 18 allowing the latter to cycle on and off according to a pre-programmed algorithm. Programmable computer 20 also controls starch delivery pump 23 allowing the latter to deliver multiple levels of starch to heat exchanger 30 for cooking. When apparatus 10 is used with more than one commercial laundry machine, programmable computer 20 is programmed to control manifold valve system 40, thus controlling the flow of cooked starch to various commercial laundry machines. Programmable computer 20 also opens and closes solenoid valve 52 to allow fresh water to flush the discharging means, tube side 32 of heat exchanger 30 and all other pipes, valves and fittings associated with the discharging means. Programmable computer 20 is enclosed in a sealed control box 62 for protection. Control box 62 houses air control switches 64 and the motor relay switches 66.

Whereas, the present invention has been described in relation to the drawings attached hereto, it should be understood that other and further modifications, apart from those shown or suggested herein, may be made within the spirit and scope of this invention.

What is claimed is:

1. A method for cooking and dispensing a starch and water solution to at least one commercial laundry washer, said method comprising the steps of:

(a) filling a mixing tank with water and dry starch to form a starch and water solution;

(b) discharging said starch and water solution from said mixing tank into at least one elongate tube of a heat exchanger;

(c) delivering a fluid heating source into a shell that substantially surrounds said elongate tube of said heat exchanger, (d) indirectly cooking said starch and water solution in said elongate tube by running said fluid heating source over said elongate tube of said heat exchanger to form a cooked starch solution; and (c) dispensing said cooked starch solution from said elongate tube of said heat exchanger to at least one commercial laundry machine.

2. The method of claim 1 further comprising heating said starch and water solution in said mixing tank to an initial temperature.

3. The method of claim 2 further comprising recirculating said starch and water solution for maintaining said initial temperature and for recirculating and mixing said starch and water solution in said mixing tank.

4. The method of claim 1 further comprising flushing said cooked starch from said elongate tube of said heat exchanger by passing water through said elongate tube of said heat exchanger after said cocked starch solution is dispensed into said at least one commercial laundry machine.

5. The method of claim 1 further comprising selecting a desired level of starch to be dispensed to said commercial laundry machine.

6. The method of claim 1 wherein said heat exchanger further comprises:

said shell containing said fluid heating source for providing heat energy to cook said starch and water solution to a final temperature;

said elongate tube for cooking said starch and water solution to form said cooked starch solution;

at least one inlet for delivering said fluid heating source into said shell;

at least one inlet for delivering said starch and water solution into said elongate tube;

at least one outlet for dispensing said fluid heating source; and at least one outlet for dispensing said cooked starch solution to said at least one commercial laundry machine.

7. A method for cooking and dispensing a starch and water solution to at least one commercial laundry washer, said method comprising the steps of:

(a) filling a mixing tank with water and dry starch to form a starch and water solution;

(b) passing said starch and water solution from said mixing tank through a heat exchanger for cooking said starch and water solution to form a cooked starch solution, wherein said heat exchanger comprises:

a tube side containing said starch and water solution;

a shell side containing a heating source for cooking said starch and water solution to form a cooked starch solution;

at least one starch and water solution inlet for delivering said starch and water solution into said tube side;

at least one heating source inlet for delivering said heating source into said shell side;

at least one cooked starch outlet for dispensing said cooked starch solution from said tube side to said at least one commercial laundry machine;

at least one heating source outlet for dispensing said heating source from said shell side; and (c) dispensing said cooked starch solution from said heat exchanger to at least one commercial laundry machine.

8. The method of claim 7 further comprising the steps of:

heating said starch and water solution in said mixing tank to an initial temperature;

recirculating said starch and water solution in said mixing tank for a first pre-determined time to prevent said starch and water solution from settling in said mixing tank and for maintaining said initial temperature of said starch and water solution;

passing said starch and water solution through said heat exchanger for cooking said starch and water solution to a final temperature to form said cooked starch solution;

passing said starch and water solution through said heat exchanger for a second pre-determined time based on a desired amount of said cooked starch solution to be dispensed to said at least one commercial laundry machine; and flushing said heat exchanger for a third pre-determined time to ensure all of said cooked starch solution is delivered to said at least one commercial laundry machine.

9. The method of claim 7 further comprising the step of selecting a desired level of starch to be dispensed to said commercial laundry machine.

10. The method of claim 1 further comprising the steps of:

(a) tilling a mixing tank with water and dry starch;

(b) mixing said water and dry starch in said mixing tank to form a starch and water solution;

(c) heating said starch and water solution in said mixing tank to an initial temperature using at least one thermostatically controlled heating element in said mixing tank;

(d) discharging said starch and water solution out a drain valve of said mixing tank and into at least one tube inlet of said elongate tube of a heat exchanger;

(e) delivering said heating fluid through at least one shell inlet into a shell of said heat exchanger;

(f) indirectly cooking said starch and water solution to a final temperature in said elongate tube by running said heating fluid over said elongate tube of said heat exchanger to form a cooked starch solution;

(g) dispensing said cooked starch solution from at least one tube outlet of said elongate tube of said heat exchanger to at least one commercial laundry machine; and (h) discharging said heating fluid from at least one shell outlet of said shell of said heat exchanger.

11. The method of claim 10 wherein said step (c) of heating said starch and water solution further comprises the steps of:

(a) maintaining said initial temperature of said starch and water solution in said mixing tank; and (b) recirculating said starch and water solution in said mixing tank.

* * * * *